US009169459B2

(12) United States Patent
Ferguson et al.

(10) Patent No.: US 9,169,459 B2
(45) Date of Patent: Oct. 27, 2015

(54) FABRIC TREATMENT COMPOSITIONS COMPRISING TARGET BENEFIT AGENTS

(75) Inventors: Paul Ferguson, Wirral (GB); Christopher Clarkson Jones, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 13/822,646

(22) PCT Filed: Aug. 8, 2011

(86) PCT No.: PCT/EP2011/063586

§ 371 (c)(1), (2), (4) Date: May 3, 2013

(87) PCT Pub. No.: WO2012/038144

PCT Pub. Date: Mar. 29, 2012

(65) Prior Publication Data

US 2013/0210697 A1 Aug. 15, 2013

(30) Foreign Application Priority Data

Sep. 20, 2010 (GB) ..... 1015672.7

(51) Int. Cl.

| | |
|---|---|
| ***C11D 3/50*** | (2006.01) |
| ***C11D 3/22*** | (2006.01) |
| ***C11D 3/386*** | (2006.01) |
| ***C11D 17/00*** | (2006.01) |
| ***D06M 13/00*** | (2006.01) |
| ***D06M 15/03*** | (2006.01) |
| ***D06M 16/00*** | (2006.01) |
| ***D06M 23/12*** | (2006.01) |
| ***D06M 23/08*** | (2006.01) |

(52) U.S. Cl.

CPC ..... *C11D 3/505* (2013.01); *C11D 3/222* (2013.01); *C11D 3/38636* (2013.01); *C11D 17/0039* (2013.01); *D06M 13/005* (2013.01); *D06M 15/03* (2013.01); *D06M 16/003* (2013.01); *D06M 23/08* (2013.01); *D06M 23/12* (2013.01)

(58) Field of Classification Search

USPC ..... 510/530, 441

See application file for complete search history.

(56) References Cited

U.S. PATENT DOCUMENTS

| | | | | |
|---|---|---|---|---|
| 5,733,854 | A * | 3/1998 | Chowdhary et al. | 510/121 |
| 2009/0275494 | A1* | 11/2009 | Ferguson et al. | 510/349 |
| 2010/0216684 | A1* | 8/2010 | Ferguson et al. | 510/337 |

FOREIGN PATENT DOCUMENTS

| | | | |
|---|---|---|---|
| CN | 101336287 | A | 12/2008 |
| EP | 0930334 | A1 | 7/1999 |
| JP | 63036774 | | 2/1988 |
| WO | WO9118974 | | 12/1991 |
| WO | WO9324622 | | 12/1993 |
| WO | WO9425576 | | 11/1994 |
| WO | WO9535362 | A1 | 12/1995 |
| WO | WO9711164 | | 3/1997 |
| WO | WO0040685 | A1 | 7/2000 |
| WO | WO2004056890 | A1 | 7/2004 |
| WO | WO2007062833 | A1 | 6/2007 |
| WO | WO2009040731 | A2 | 4/2009 |

OTHER PUBLICATIONS

Notification of the First Office Action Issued by the State Intellectual Property Office of the People's Republic of China for Chinese Patent Application No. 201180045108.7 dated Dec. 4, 2013.

Talbot et al., Purification and Characterization fo Thermostable B-Mananase and, Applied and Environmental Microbioligy, Nov. 1990, vol. 56 No. 11, pp. 3505-3510.

PCT International Search Report in PCT application PCT/EP2011/063586 dated Feb. 9, 2012 with Written Opinion.

* cited by examiner

*Primary Examiner* — Ling Choi

*Assistant Examiner* — Thuy-Al Nguyen

(74) *Attorney, Agent, or Firm* — Greenberg Traurig, LLP

(57) ABSTRACT

The invention provides a composition comprising: a) a benefit agent (preferably perfume) delivery particle comprising a poly-xyloglucan or poly-galactomannan with a ratio of beta-1,4 to 1,6 linkages of 1:1 to 3:1, or a mixture thereof as a delivery aid, b) a mannanase, preferably in combination with one or more of lipase, protease and amylase. Preferably the delivery particle is a core-shell encapsulate.

5 Claims, No Drawings

FABRIC TREATMENT COMPOSITIONS COMPRISING TARGET BENEFIT AGENTS

TECHNICAL FIELD

The present invention relates to fabric treatment compositions and, more specifically, to compositions comprising particles which comprise a benefit agent (preferentially perfume) and the deposition aid. The invention also relates to delivery of the benefit agent (preferably perfume) to fabric during laundering.

BACKGROUND OF THE INVENTION

The present invention will be described with particular reference to perfume although the technology is believed applicable to other benefit agents used in fabric treatment processes.

In laundry applications deposition of a perfume is used, for example, during fabric treatment processes such as fabric washing and conditioning. Methods of deposition are diverse and include deposition during the wash or rinse stages of the laundry process or direct deposition before or after the wash, such as by spraying or rubbing or by use of impregnated sheets during tumble drying or water additives during steam ironing. The perfume is often incorporated into a carrier or delivery system. Carrier systems for perfumes are typically based on encapsulation or entrapment of the perfume within a matrix. After deposition onto a surface, a problem exists in that longevity of adherence to that surface of the perfume, in a surfactant containing environment, is inherently poor. A perfume which has been deposited onto a fabric may be washed off again during a main wash, or the perfume may be leached from its carrier into the wash. Protection of the perfume is, therefore, required before and after it has been deposited onto a surface. Much the same problems are encountered with other benefit agents, which are, like perfume typically relatively expensive and present in laundry compositions at relatively low levels.

WO 07/62833 relates to compositions which comprise core-shell encapsulated perfume particles decorated with a polysaccharide which is substantive to cellulose. Preferred polysaccharides disclosed therein are locust bean gum, tamarind xyloglucan, guar gum or mixtures thereof. Thus it is known to have particles comprising a benefit agent (perfume) which use cellulose-substantive polysaccharide as a delivery aid to assist the particles in binding to a specific substrate. The compositions may also contain one or more enzymes. Suitable enzymes disclosed in the reference include, amongst others, those known as cellulase.

The term cellulase refers to a class of enzymes which show a range of possible reactions on a variety of substrates. One problem with cellulose-substantive polysaccharides is that they have a structure which is generally similar to cellulose, and as such, are subject to attack by "cellulase".

Other enzymes which attack polysaccharides are known, for example mannanases are used in combination with other enzymes as an effective medium against soil from certain food products (such as ice cream, tomato sauce or salad dressing) that contain guar gum. Guar gum is a food additive that is obtained from the seed of the guar tree and is used in numerous products as ballast or as a gelling agent. Guar gum is also found in some hair styling products and make-up products. As noted above, guar gum is substantive to cellulose. Mannanases have been identified in several *Bacillus* organisms. For example, Talbot et al., Appl. Environ. Microbiol., vol. 56, No. 11, pp. 3505-3510 (1990) describes a β-mannanase derived from *Bacillus stearothermophilus* in dimer form having a MW of 162 kDa and an optimum pH of 5.5-7.5. Mendoza et al., World J. Micobio. Biotech., vol. 10, no. 5, pp. 551-555 (1994) describes a β-mannanase derived from *Bacillus subtilisis* having a MW of 38 kDa, an optimum activity at pH 5.0/55° C. and a pI of 4.8. J0304706 discloses a β-mannanase derived from *Bacillus* sp. having a MW of 37 +/−3 kDa measured by gel filtration, an optimum pH of 8-10 and a pI of 5.3-5.4. J63056289 describes the production of an alkaline, thermostable β-mannanase, which hydrolyses β-1, 4-D-mannopyranoside bonds of e.g. mannans and produces manno:oligo:saccharides. J63036774 relates to a *Bacillus* microorganism FERM P-8856 which produces β-mannanase and β-mannosidase, at an alkaline pH. A purified mannanase from *Bacillus amyloliquefaciens* and its method of preparation useful in the bleaching of pulp and paper, is disclosed in WO97/11164. WO91/18974 describes an hemicellulase such as a glucanase, xylanase or mannanase, active at extreme pH and temperature and the production thereof. WO94/25576 describes an enzyme exhibiting a mannanase activity derived from *Aspergillus aculeatus* CBS 101.43, that might be used for various purposes for which degradation or modification of plant or algae cell wall material is desired. WO93/24622 discloses a mannanase isolated from *Trichoderrna reesei* for bleaching lignocellulosic pulps.

BRIEF DESCRIPTION OF THE INVENTION

We have now determined that particles comprising a benefit agent which use xyloglucan or guar gum as a delivery aid are effective in compositions which comprise mannanase, even though it would be expected that the mannanase would digest the delivery aid.

Accordingly, a first aspect of the present invention provides a composition comprising:

a) a benefit agent delivery particle comprising a poly-xyloglucan or poly-galactomannan with a ratio of beta-1,4 to 1,6 linkages of 0.5:1 to 3:1 (preferably 1:1 to 3:1), or a mixture thereof as a delivery aid, b) a mannanase.

Just why the attachment of the xyloglucan to particles prevents the degradation of the poly-xyloglucan or the poly-galactomannan by the mannanase is not understood as it would be expected, especially in the case of the poly-galactomannan (for example guar gum) that this would be the case.

DETAILED DESCRIPTION OF THE INVENTION

In order that the present invention may be further understood it is described in further detail below with particular reference to preferred features.

Polysaccharide Delivery Aid:

Polysaccharide structures for the delivery aid are selected from the group consisting of poly-xyloglucan and poly-galactomannans other than Locust Bean Gum. Naturally-occurring polymer structures or the shorter hydrolysis products of naturally occurring polymer structures are particularly preferred. For example, preferred polysaccharide structures are those of tamarind xyloglucan, guar gum or mixtures thereof.

Xyloglucan has a backbone of beta 1,4-linked glucose residues most of which are substituted with 1-6 linked xylose sidechains. Galactomannans, have a beta 1,4-linked D-mannopyranose backbone with branchpoints from their 6-positions linked to alpha-D-galactose, i.e. 1-6-linked alpha-D-galactopyranose).

The polysaccharides of the present invention have a ratio of beta-1,4 to 1,6 linkages to other linkages of 0.5:1 to 3:1. The beta-1,4 to 1,6 ratio in Locust Bean Gum (i.e. mannose to galactose) is around 4:1.

Benefit Agents:

Benefit agents provide a range of benefits to cloth. These include benefits of softening, conditioning, lubricating, crease reducing, ease of ironing, moisturising, colour preserving and/or anti-pilling, quick drying, UV protecting, shape retaining, soil releasing, texturising, insect repelling, fungicidal, dyeing and/or fluorescent benefit to the fabric.

A highly preferred benefit is the delivery of fragrance.

Preferred benefit agents are perfume (whether free and/or encapsulated), pro-fragrance, clays, enzymes, antifoams, fluorescer, bleaching agents and precursors thereof (including photo-bleach), shading dyes and/or pigments, fabric conditioning agents (for example cationic surfactants including water-insoluble quaternary ammonium materials and/or silicones), lubricants, photo-protective agents (including sunscreens), antioxidants, reducing agents, sequestrants, colour care additives (including dye fixing agents), unsaturated oil, emollients insect repellents and/or pheromones and anti-microbial and microbe control agents. Mixtures of two or more of these may be employed. Particular benefit agents are described in further detail below.

Benefit Agent Association and Carriers:

The delivery aid polymer is attached to a particle which either comprises the benefit agent per-se or which is itself a carrier for the benefit agent. An example of such would be a perfume carrying particle with the polymer attached to the surface of the particle. It should be noted that the attachment of the delivery aid is such that the delivery aid is not removed on exposure of the particles to water While it is preferred to use polymer particles, preferably core-shell encapsulates, many other types of particle can be envisaged as the benefit agent carrier. Perfumes have been adsorbed onto a clay or zeolite material that is then admixed into particulate detergent compositions: U.S. Pat. No. 4,539,135 discloses particulate laundry compounds comprising a clay or zeolite material carrying perfume. Combinations of perfumes generally with larger pore size zeolites such as zeolite X and Y are also taught in the art. East German Patent Publication No. 248,508, relates to perfume dispensers containing a faujasite-type zeolite (e.g., zeolite X and Y) loaded with perfume. Also, East German Patent Publication No. 137,599, published Sep. 12, 1979 teaches compositions for use in powdered washing agents to provide thermoregulated release of perfume. Zeolites A, X and Y are taught for use in these compositions. Other perfume delivery systems are taught by WO 97/34982 and WO 98/41607, published by The Procter & Gamble. WO 97/34982 discloses particles comprising perfume loaded zeolite and a release barrier, which is an agent derived from a wax and having a size (i.e., a cross-sectional area) larger than the size of the pore openings of the zeolite carrier. WO 98/41607 discloses glassy particles comprising agents useful for laundry or cleaning compositions and a glass derived from one or more of at least partially-water-soluble hydroxylic compounds.

Silicas, amorphous silicates, crystalline nonlayer silicates, layer silicates, calcium carbonates, calcium/sodium carbonate double salts, sodium carbonates, sodalites, alkali metal phosphates, pectin, chitin microbeads, carboxyalkylcelluloses, gums, resins, gelatin, gum arabic, porous starches, modified starches, carboxyalkyl starches, cyclodextrins, maltodextrins, synthetic polymers such as polyvinyl pyrrolidone (PVP), polyvinyl alcohol (PVA), cellulose ethers, polystyrene, polyacrylates, polymethacrylates, polyolefins, aminoplast polymers, crosslinkers and mixtures thereof can all provide a basis for perfume particles.

Polymer particles are preferred.

In one preferred aspect of the invention the polymer, as deposition aid, is attached to at least partially pre-formed particles.

The polymer is bound to the particle by means of a covalent bond, entanglement or strong adsorption, preferably by a covalent bond or entanglement and most preferably by means of a covalent bond. By entanglement as used herein is meant that the deposition aid is adsorbed onto the particle as the polymerisation proceeds and the particle grows in size. It is believed that under such circumstances part of the adsorbed deposition aid becomes buried within the interior of the particle. Hence at the end of the polymerisation, part of the deposition aid is entrapped and bound in the polymer matrix of the particle, whilst the remainder is free to extend into the aqueous phase.

The deposition aid is preferably mainly attached to the particle surface and is not, to any significant extent, distributed throughout the internal bulk of the particle. Thus the particle which is produced when using a deposition aid according to the preferred process of the invention can be thought of as a "hairy particle". This feature of the invention provides significant cost reduction opportunities for the manufacturer as much less polymer is required as a deposition aid.

Other types of particle surface morphology may be produced when a deposition aid is attached to the particle of the invention. For example, where a polymer attaches to the particle surface in multiple places, loops may result.

The polymer carrier particles of the invention can comprise a wide selection of monomeric units. By "monomer units" as used herein is meant the monomeric units of the polymer chain, thus references to "a polymer particle comprising insoluble monomer units" as used herein means that the polymer particle is derived from insoluble monomers, and so forth.

As noted above, the monomer units are preferably derived from monomers which are suitable for either step growth polymerisation or addition/free radical polymerisation.

Where used, perfume is typically present in an amount of from 10-85% by total weight of the carrier particle, preferably from 20 to 75% by total weight of the particle.

The perfume suitably has a molecular weight of from 50 to 500. Where pro-fragrances are used the molecular weight will generally be higher.

Useful components of the perfume include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products, i.e., of imparting an odour and/or a flavour or taste to a consumer product traditionally perfumed or flavoured, or of modifying the odour and/or taste of said consumer product.

By perfume in this context is not only meant a fully formulated product fragrance, but also selected components of that fragrance, particularly those which are prone to loss, such as the so-called 'top notes'. The perfume component could also be in the form of a profragrance. WO 2002/038120 (P&G), for example, relates to photo-labile pro-fragrance conjugates which upon exposure to electromagnetic radiation are capable of releasing a fragrant species.

Top notes are defined by Poucher (Journal of the Society of Cosmetic Chemists 6(2):80 [1955]). Examples of well known top-notes include citrus oils, linalool, linalyl acetate, lavender, dihydromyrcenol, rose oxide and cis-3-hexanol. Top notes typically comprise 15-25% wt of a perfume composition and in those embodiments of the invention which contain an increased level of top-notes it is envisaged at that least 20% wt would be present within the encapsulate.

Typical perfume components which it is advantageous to encapsulate, include those with a relatively low boiling point, preferably those with a boiling point of less than 300, preferably 100-250 Celsius.

It is also advantageous to encapsulate perfume components which have a low Log P (ie. those which will be partitioned into water), preferably with a Log P of less than 3.0. These materials, of relatively low boiling point and relatively low Log P have been called the "delayed blooming" perfume ingredients and include the following materials:

Allyl Caproate, Amyl Acetate, Amyl Propionate, Anisic Aldehyde, Anisole, Benzaldehyde, Benzyl Acetate, Benzyl Acetone, Benzyl Alcohol, Benzyl Formate, Benzyl Iso Valerate, Benzyl Propionate, Beta Gamma Hexenol, Camphor Gum, Laevo-Carvone, d-Carvone, Cinnamic Alcohol, Cinamyl Formate, Cis-Jasmone, cis-3-Hexenyl Acetate, Cuminic Alcohol, Cyclal C, Dimethyl Benzyl Carbinol, Dimethyl Benzyl Carbinol Acetate, Ethyl Acetate, Ethyl Aceto Acetate, Ethyl Amyl Ketone, Ethyl Benzoate, Ethyl Butyrate, Ethyl Hexyl Ketone, Ethyl Phenyl Acetate, Eucalyptol, Eugenol, Fenchyl Acetate, Flor Acetate (tricyclo Decenyl Acetate), Frutene (tricycico Decenyl Propionate), Geraniol, Hexenol, Hexenyl Acetate, Hexyl Acetate, Hexyl Formate, Hydratropic Alcohol, Hydroxycitronellal, Indone, Isoamyl Alcohol, Iso Menthone, Isopulegyl Acetate, Isoquinolone, Ligustral, Linalool, Linalool Oxide, Linalyl Formate, Menthone, Menthyl Acetphenone, Methyl Amyl Ketone, Methyl Anthranilate, Methyl Benzoate, Methyl Benzyl Acetate, Methyl Eugenol, Methyl Heptenone, Methyl Heptine Carbonate, Methyl Heptyl Ketone, Methyl Hexyl Ketone, Methyl Phenyl Carbinyl Acetate, Methyl Salicylate, Methyl-N-Methyl Anthranilate, Nerol, Octalactone, Octyl Alcohol, p-Cresol, p-Cresol Methyl Ether, p-Methoxy Acetophenone, p-Methyl Acetophenone, Phenoxy Ethanol, Phenyl Acetaldehyde, Phenyl Ethyl Acetate, Phenyl Ethyl Alcohol, Phenyl Ethyl Dimethyl Carbinol, Prenyl Acetate, Propyl Bornate, Pulegone, Rose Oxide, Safrole, 4-Terpinenol, Alpha-Terpinenol, and/or Viridine It is commonplace for a plurality of perfume components to be present in a formulation. In the encapsulates of the present invention it is envisaged that there will be four or more, preferably five or more, more preferably six or more or even seven or more different perfume components from the list given of delayed blooming perfumes given above present in the encapsulated perfume.

Part or all of the perfume may be in the form of a pro-fragrance. For the purposes of the present invention a pro-fragrance is any material which comprises a fragrance precursor that can be converted into a fragrance.

Suitable pro-fragrances are those that generate perfume components which are aldehydes. Aldehydes useful in perfumery include but are not limited to phenylacetaldehyde, p-methyl phenylacetaldehyde, p-isopropyl phenylacetaldehyde, methylnonyl acetaldehyde, phenylpropanal, 3-(4-t-butylphenyl)-2-methyl propanal, 3-(4-t-butylphenyl)-propanal, 3-(4-methoxyphenyl)-2-methylpropanal, 3-(4-isopropylphenyl)-2-methylpropanal, 3-(3,4-methylenedioxyphenyl)-2-methyl propanal, 3-(4-ethylphenyl)-2,2-dimethylpropanal, phenylbutanal, 3-methyl-5-phenylpentanal, hexanal, trans-2-hexenal, cis-hex-3-enal, heptanal, cis-4-heptenal, 2-ethyl-2-heptenal, 2,6-dimethyl-5-heptenal, 2,4-heptadienal, octanal, 2-octenal, 3,7-dimethyloctanal, 3,7-dimethyl-2,6-octadien-1-al, 3,7-dimethyl-1,6-octadien-3-al, 3,7-dimethyl-6-octenal, 3,7-dimethyl-7-hydroxyoctan-1-al, nonanal, 6-nonenal, 2,4-nonadienal, 2,6-nonadienal, decanal, 2-methyl decanal, 4-decenal, 9-decenal, 2,4-decadienal, undecanal, 2-methyl-decanal, 2-methylundecanal, 2,6,10-trimethyl-9-undecenal, undec-10-enyl aldehyde, undec-8-enanal, dodecanal, tridecanal, tetradecanal, anisaldehyde, bourgenonal, cinnamic aldehyde, a-amylcinnam-aldehyde, a-hexyl cinnamaldehyde, methoxy-cinnamaldehyde, citronellal, hydroxy-citronellal, isocyclocitral, citronellyl oxyacet-aldehyde, cortexaldehyde, cumminic aldehyde, cyclamen aldehyde, florhydral, heliotropin, hydrotropic aldehyde, lilial, vanillin, ethyl vanillin, benzaldehyde, p-methyl benzaldehyde, 3,4-dimethoxybenzaldehyde, 3- and 4-(4-hydroxy-4-methyl-pentyl)-3-cyclohexene-1-carboxaldehyde, 2,4-dimethyl-3-cyclohexene-1-carboxaldehyde, 1-methyl-3-(4-methylpentyl)-3-cyclohexen-carboxaldehyde, p-methylphenoxyacetaldehyde, and mixtures thereof.

Another group of perfumes with which the present invention can be applied are the so-called 'aromatherapy' materials. These include many components also used in perfumery, including components of essential oils such as Clary Sage, Eucalyptus, Geranium, Lavender, Mace Extract, Neroli, Nutmeg, Spearmint, Sweet Violet Leaf and Valerian. By means of the present invention these materials can be transferred to textile articles that will be worn or otherwise come into contact with the human body (such as handkerchiefs and bed-linen).

The perfume may be encapsulated alone or co-encapsulated with carrier materials, further deposition aids and/or fixatives. Preferred materials to be co-encapsulated in carrier particles with the perfume include waxes, paraffins, stabilizers and fixatives.

An optional yet preferred component of carrier particles is a formaldehyde scavenger. This is particularly advantageous in carrier particles which may comprise formaldehyde as a consequence of their manufacturing process or components. Formaldehyde scavenger is chosen from: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly (vinyl alcohol), poly(vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, chitosan, or a mixture thereof. Preferred formaldehyde scavengers are sodium bisulfite, ethyl acetoacetate, acetoacetamide, ethylenediamine-N,N'-bisacetoacetamide, ascorbic acid, 2,2-dimethyl-1,3-dioxan-4,6-dione, helional, triplal, lilial and mixtures thereof.

Process Details

The process for the preparation of the particles is preferably a two step process in which the first step forms a particle comprising the benefit agent and the second step applies a coating to the capsule which includes the polymer as a deposition aid. The first step can either be step-growth or addition polymerisation and the second step is preferably addition polymerisation. In the alternative, a particle may be formed which is capable of adsorbing a benefit agent (such as perfume) and the older shell, containing the deposition aid, may be added before the particle is exposed to the benefit agent.

Suitable classes of monomers for step-growth polymerisation are given in the group consisting of the melamine/urea/formaldehyde class, the isocyanate/diol class (preferably the polyurethanes) and polyesters. Preferred are the melamine/urea formaldehyde class and the polyurethanes.

Suitable classes of monomers for addition/free radical polymerisation are given in the group consisting of olefins, ethylene, vinylaromatic monomers, esters of vinyl alcohol with mono- and di-carboxylic acids, esters of α,β-monoethylenically unsaturated mono- and dicarboxylic acids with alcohols, nitriles of α,β-monoethylenically unsaturated carboxylic acids, conjugated dienes, α,β-monoethylenically unsaturated monocarboxylic and dicarboxylic acids and their amides, methacrylic acid and its esters with alcohols and diols, acrylic acid and its esters with alcohols and diols, dimethyl or di-n-butyl maleate, and vinyl-sulfonic acid and its water-soluble salts, and mixtures thereof. The polymer particle may comprise mixtures of monomer units.

The polymer particle may optionally comprise monomers which are cross-linkers. Such cross-linkers may have at least two non-conjugated ethylenically unsaturated double bonds. Examples are alkylene glycol diacrylates and dimethacrylates. A further type of suitable cross-linking monomers are those that are conjugated, such as divinyl benzene. If present, these monomers constitute from 0.1 to 10% by weight, based on the total amount of monomers to be polymerised.

The monomers are preferably selected from: styrene; α-methylstyrene; o-chlorostyrene; vinyl acetate; vinyl propionate; vinyl n-butyrate; esters of acrylic, methacrylic, maleic, fumaric or itaconic acid with methyl, ethyl, n-butyl, isobutyl, n-hexyl and 2-ethylhexyl alcohol; 1,3-butadiene; 2,3 dimethyl butadiene; and isoprene. The preferred monomers are vinyl acetate and methyl acrylate.

Optionally, the monomers are used as co-polymers with one or more of acrylic acid, methacrylic acid, maleic acid, fumaric acid, itaconic acid, poly(alkylene oxide) monoacrylates and monomethacrylates, N-vinyl-pyrrolidone, methacrylic and acrylic acid, 2-hydroxyethyl acrylates and methacrylates, glycerol acrylates and methacrylates, poly (ethylene glycol) methacrylates and acrylates, n-vinyl pyrrolidone, acryloyl morpholine, vinyl formamide, n-vinyl acetamide and vinyl caprolactone, acrylonitrile (71 g/l), acrylamide, and methacrylamide at levels of less than 10% by weight of the monomer unit content of the particle; 2-(dimethylamino) ethyl methacrylate, 2-(diethylamino) ethyl methacrylate, 2-(tert-butylamino) ethyl methacrylate, 2-aminoethyl methacrylate, 2-(2-oxo-1-imidazolidinyl)ethyl methacrylate, vinyl pyridine, vinyl carbazole, vinyl imidazole, vinyl aniline, and their cationic forms after treatment with alkyl halides.

Optional cross linkers include vinyltoluenes, divinyl benzene, ethylene glycol diacrylate, 1,2-propylene glycol diacrylate, 1,3-propylene glycol diacrylate, 1,3-butylene glycol diacrylate, 1,4-butylene glycol diacrylates, ethylene glycol dimethacrylate, 1,2-propylene glycol dimethacrylate, 1,3-propylene glycol dimethacrylate, 1,3-butylene glycol dimethacrylate, 1,4-butylene glycol dimethacrylate, divinylbenzene, vinyl methacrylate, vinyl acrylate, allyl methacrylate, allyl acrylate, diallyl maleate, diallyl fumarate, methylenebisacrylamide, cyclopentadienyl acrylate, and triallyl cyanurate. It is preferable that the ratio of the monomers used in the shell formation and those used in deposition aid attachment are the ratio of 20:1 to 1:1 (as shell formation to deposition linker). Preferably, the ratio is 5:1-2:1, more preferably 4:1-2:1 as better particle deposition on fabric is found as the ratio approaches 2:1.

As noted above the process for the preparation of the particles is preferably a two step process in which the first step forms a capsule around the benefit agent and the second step applies a coating to the capsule which includes the deposition aid. The first step can either be step-growth or addition polymerisation and the second step is preferably addition polymerisation.

It is particularly preferably that the first step uses monomers selected from melamine/urea-formaldehyde or methylmethacrylate or isocyanate/diol, and the second step uses monomers selected from vinyl acetate and/or methyl acyrlate. Vinyl acetate is particularly preferred as it gives a low viscosity slurry.

It is particularly preferred that the non-ionic deposition aid is not added until the second step.

For step-growth polymerisation some heating is generally necessary to cause polymerisation to proceed. Initiators and chain transfer agents may also be present in the polymerisation mixture where use is made of any addition polymerisation. Those skilled in the art will recognise that a chemical initiator will generally be required for addition polymerisation but that there are instances in which alternative forms of initiation will be possible, e.g. ultrasonic initiation or initiation by irradiation.

The initiator is preferably a chemical or chemicals capable of forming free radicals. Typically, free radicals can be formed either by homolytic scission (i.e. homolysis) of a single bond or by single electron transfer to or from an ion or molecule (e.g. redox reactions). Suitably, in context of the invention, homolysis may be achieved by the application of heat (typically in the range of from 50 to 100° C.). Some examples of suitable initiators in this class are those possessing peroxide (—O—O—) or azo (—N=N—) groups, such as benzoyl peroxide, t-butyl peroxide, hydrogen peroxide, azobisisobutyronitrile and ammonium persulphate. Homolysis may also be achieved by the action of radiation (usually ultraviolet), in which case it is termed photolysis. Examples are the dissociation of 2,2'-azobis(2-cyanopropane) and the formation of free radicals from benzophenone and benzoin. Redox reactions can also be used to generate free radicals. In this case an oxidising agent is paired with a reducing agent which then undergo a redox reaction. Some examples of appropriate pairs in the context of the invention are ammonium persulphate/sodium metabisulphite, cumyl hydroperoxide/ferrous ion and hydrogen peroxide/ascorbic acid.

Preferred initiators are selected from the following:

Homolytic: benzoyl peroxide, t-butyl peroxide, hydrogen peroxide, azobisisobutyronithle, ammonium persulphate, 2,2'-azobis(cyanopropane), benzophenone, benzoin, Redox: ammonium persulphate/sodium metabisulphite mixture, cumyl hydroperoxide/ferrous ion mixture and/or hydrogen peroxide/ascorbic acid mixture.

Preferred initiators are ammonium persulphate and hydrogen peroxide/ascorbic acid mixture. The preferred level of initiator is in the range of from 0.1 to 5.0% w/w by weight of monomer, more preferably, the level is in the range of from 1.0 to 3.0% w/w by weight of monomer.

Chain transfer agents can optionally be used. A chain transfer agent contains very labile hydrogen atoms that are easily abstracted by a propagating polymer chain. This terminates the polymerisation of the growing polymer, but generates a new reactive site on the chain transfer agent that can then proceed to initiate further polymerisation of the remaining monomer. Chain transfer agents in the context of the invention typically contain thiol (mercaptan) functionality and can be represented by the general chemical formula RS—H, such as n-dodecyl mercaptan and 2-mercaptoethanol. Preferred chain transfer agents are monothioglycerol and n-dodecyl mercaptan, used at levels of, preferably from 0 to 5% w/w based on the weight of the monomer and more preferably at a level of 0.25% w/w based on the weight of the monomer.

It is possible to use commercially available perfume particles in the process. However some care needs be taken that materials present in the dispersions in which such particles are commercially available do not interfere with the polymerisation process. For example gums which may be present as thickeners should be avoided as these can interact with the xyloglucan. In addition materials should not be present which would inhibit and radical chemistry being used to form polymer shells.

The preferred product of such a process is a slurry or dispersion comprising some 30-50% of solids.

The most preferred compositions are those wherein the benefit agent delivery particle is a core/shell particle with perfume present in the core and an aminoplast shell, the shell be surrounded with a outer layer of polyvinyl acetate, said outer layer also comprising a poly-xyloglucan delivery aid.

Laundry Treatment Compositions

The deposition aid linked polymer particles of the invention may be incorporated into laundry compositions. This may be done by mixing a slurry/dispersion product with some or all of the other components of the composition, preferably by spraying onto the components. Advantageously, the slurry/dispersion need not be dried extensively (if at all) and this reduces benefit agent losses.

The polymer particles are typically included in said compositions at levels of from 0.001% to 10%, preferably from 0.005% to 5%, most preferably from 0.01% to 3% by weight of the total composition.

The active ingredient in the compositions is preferably a surface active agent or a fabric conditioning agent. More than one active ingredient may be included. For some applications a mixture of active ingredients may be used.

The compositions of the invention may be in any physical form e.g. a solid such as a powder or granules, a tablet, a solid bar, a paste, gel or liquid, especially, an aqueous based liquid. In particular the compositions may be used in laundry compositions, especially in liquid, powder or tablet laundry composition.

The compositions of the present invention are preferably laundry compositions, especially main wash (fabric washing) compositions or rinse-added softening compositions. The main wash compositions may include a fabric softening agent and the rinse-added fabric softening compositions may include surface-active compounds, particularly non-ionic surface-active compounds.

The detergent compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic, and non-ionic compounds.

Mannanase:

The enzyme Mannanase is an essential component of products according to the present invention. Examples of suitable mannanases (EC 3.2.1.78) include mannanases of bacterial and fungal origin. In a specific embodiment the mannanase is derived from a strain of the filamentous fungus genus *Aspergillus*, preferably *Aspergillus niger* or *Aspergillus aculeatus* (WO 94/25576). WO 93/24622 discloses a mannanase isolated from *Trichoderma reesei*.

Mannanases have also been isolated from several bacteria, including *Bacillus* organisms. For example, Talbot et al., Appl. Environ. Microbiol., Vol. 56, No. 11, pp. 3505-3510 (1990) describes a beta-mannanase derived from *Bacillus stearothermophilus*. Mendoza et al., World J. Microbiol. Biotech., Vol. 10, No. 5, pp. 551-555 (1994) describes a beta-mannanase derived from *Bacillus subtilis*. JP-A-03047076 discloses a beta-mannanase derived from *Bacillus* sp. JP-A-63056289 describes the production of an alkaline, thermostable beta-mannanase. JP-A-63036775 relates to the *Bacillus* microorganism FERM P-8856 which produces beta-mannanase and beta-mannosidase. JP-A-08051975 discloses alkaline beta-mannanases from alkalophilic *Bacillus* sp. AM-001. A purified mannanase from *Bacillus amyloliquefaciens* is disclosed in WO 97/11164. WO 91/18974 describes a hemicellulase such as a glucanase, xylanase or mannanase active.

Also contemplated are the alkaline family 5 and 26 mannanases derived from *Bacillus agaradhaerens, Bacillus licheniformis, Bacillus halodurans, Bacillus clausii, Bacillus* sp., and *Humicola insolens* disclosed in WO 99/64619.

Especially contemplated are the *Bacillus* sp. mannanases concerned in the Examples in WO 99/64619 which document is hereby incorporated by reference.

Examples of commercially available mannanases include Mannaway™ available from Novozymes A/S Denmark.

Other Enzymes:

In a particularly preferred embodiment of the invention the laundry composition being tested comprises at least one further enzyme other than mannanase. Especially contemplated enzymes include proteases, alpha-amylases, lipases, peroxidases/oxidases, pectate lyases, or mixtures thereof.

Suitable proteases include those of animal, vegetable or microbial origin. Microbial origin is preferred. Chemically modified or protein engineered mutants are included. The protease may be a serine protease or a metallo protease, preferably an alkaline microbial protease or a trypsin-like protease. Examples of alkaline proteases are subtilisins, especially those derived from *Bacillus*, e.g., subtilisin Novo, subtilisin Carlsberg, subtilisin 309, subtilisin 147 and subtilisin 168 (described in WO 89/06279). Examples of trypsin-like proteases are trypsin (e.g. of porcine or bovine origin) and the *Fusarium* protease described in WO 89/06270 and WO 94/25583.

Examples of useful proteases are the variants described in WO 92/19729, WO 98/20115, WO 98/20116, and WO 98/34946, especially the variants with substitutions in one or more of the following positions: 27, 36, 57, 76, 87, 97, 101, 104, 120, 123, 167, 170, 194, 206, 218, 222, 224, 235 and 274. Preferred commercially available protease enzymes include Alcalase™, Savinase™, Primase™, Duralase™, Dyrazym™, Esperase™, Everlase™, Polarzyme™, and Kannase™, (Novozymes A/S), Maxatase™, Maxacal™, Maxapem™, Properase™, Purafect™, Purafect OxP™, FN2™, and FN3™ (Genencor International Inc.).

Suitable lipases include those of bacterial or fungal origin. Chemically modified or protein engineered mutants are included. Examples of useful lipases include lipases from *Humicola* (synonym *Thermomyces*), e.g. from *H. lanuginosa* (*T. lanuginosus*) as described in EP 258 068 and EP 305 216 or from *H. insolens* as described in WO 96/13580, a *Pseudomonas lipase*, e.g. from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus lipase*, e.g. from *B. subtilis* (Dartois et al. (1993), Biochemica et Biophysica Acta, 1131, 253-360), *B. stearothermophilus* (JP 64/744992) or *B. pumilus* (WO 91/16422).

Other examples are lipase variants such as those described in WO 92/05249, WO 94/01541, EP 407 225, EP 260 105, WO 95/35381, WO 96/00292, WO 95/30744, WO 94/25578, WO 95/14783, WO 95/22615, WO 97/04079 and WO 97/07202. Preferred commercially available lipase enzymes include Lipolase™, Lipolase Ultra™ and Lipex™ (Novozymes A/S).

Compositions of the invention may include cutinase as classified in EC 3.1.1.74. The cutinase used according to the invention may be of any origin. Preferably cutinases are of microbial origin, in particular of bacterial, of fungal or of yeast origin.

Cutinases are enzymes which are able to degrade cutin. In a preferred embodiment, the cutinase is derived from a strain of *Aspergillus*, in particular *Aspergillus oryzae*, a strain of *Alternaria*, in particular *Alternaria brassiciola*, a strain of *Fusarium*, in particular *Fusarium solani, Fusarium solani pisi, Fusarium roseum culmorum*, or *Fusarium roseum sambucium*, a strain of *Helminthosporum*, in particular *Helminthosporum sativum*, a strain of *Humicola*, in particular *Humicola insolens*, a strain of *Pseudomonas*, in particular *Pseudomonas mendocina*, or *Pseudomonas putida*, a strain of *Rhizoctonia*, in particular *Rhizoctonia solani*, a strain of *Streptomyces*, in particular *Streptomyces scabies*, or a strain of *Ulocladium*, in particular *Ulocladium consortiale*. In a most preferred embodiment the cutinase is derived from a strain of *Humicola* insolens, in particular the strain *Humicola* insolens DSM 1800. *Humicola* insolens cutinase is described in WO 96/13580 which is hereby incorporated by reference. The cutinase may be a variant, such as one of the variants disclosed in WO 00/34450 and WO 01/92502, which are hereby incorporated by reference. Preferred cutinase variants include variants listed in Example 2 of WO 01/92502, which is hereby specifically incorporated by reference.

Preferred commercial cutinases include NOVOZYM™ 51032 (available from Novozymes A/S, Denmark).

Compositions according to the invention may include phospholipase classified as EC 3.1.1.4 and/or EC 3.1.1.32. As used herein, the term phospholipase is an enzyme which has activity towards phospholipids. Phospholipids, such as lecithin or phosphatidylcholine, consist of glycerol esterified with two fatty acids in an outer (sn-1) and the middle (sn-2) positions and esterified with phosphoric acid in the third position; the phosphoric acid, in turn, may be esterified to an amino-alcohol. Phospholipases are enzymes which participate in the hydrolysis of phospholipids. Several types of phospholipase activity can be distinguished, including phospholipases A1 and A2 which hydrolyze one fatty acyl group (in the sn-1 and sn-2 position, respectively) to form lysophospholipid; and lysophospholipase (or phospholipase B) which can hydrolyze the remaining fatty acyl group in lysophospholipid. Phospholipase C and phospholipase D (phosphodiesterases) release diacyl glycerol or phosphatidic acid respectively.

The term phospholipase includes enzymes with phospholipase activity, e.g., phospholipase A (A1 or A2), phospholipase B activity, phospholipase C activity or phospholipase D activity. The term "phospholipase A" used herein in with an enzyme of the invention is intended to cover an enzyme with Phospholipase A1 and/or Phospholipase A2 activity. The phospholipase activity may be provided by enzymes having other activities as well, such as, e.g., a lipase with phospholipase activity. The phospholipase activity may, e.g., be from a lipase with phospholipase side activity. In other embodiments of the invention the phospholipase enzyme activity is provided by an enzyme having essentially only phospholipase activity and wherein the phospholipase enzyme activity is not a side activity.

The phospholipase may be of any origin, e.g., of animal origin (such as, e.g., mammalian), e.g. from pancreas (e.g., bovine or porcine pancreas), or snake venom or bee venom. Preferably the phospholipase may be of microbial origin, e.g., from filamentous fungi, yeast or bacteria, such as the genus or species *Aspergillus*, e.g., *A. niger; Dictyostelium*, e.g., *D. discoideum; Mucor*, e.g. *M. javanicus, M. mucedo, M. subtilissimus; Neurospora*, e.g. *N. crassa; Rhizomucor*, e.g., *R. pusillus; Rhizopus*, e.g. *R. arrhizus, R. japonicus, R. stolonifer; Sclerotinia*, e.g., *S. libertiana; Trichophyton*, e.g. *T. rubrum; Whetzelinia*, e.g., *W. sclerotiorum; Bacillus*, e.g., *B. megaterium, B. subtilis; Citrobacter*, e.g., *C. freundii; Enterobacter*, e.g., *E. aerogenes, E. cloacae Edwardsiella, E. tarda; Erwinia*, e.g., *E. herbicola; Escherichia*, e.g., *E. coli; Klebsiella*, e.g., *K. pneumoniae; Proteus*, e.g., *P. vulgaris; Providencia*, e.g., *P. stuartii; Salmonella*, e.g. *S. typhimurium; Serratia*, e.g., *S. liquefasciens, S. marcescens; Shigella*, e.g., *S. flexneri; Streptomyces*, e.g., *S. violeceoruber; Yersinia*, e.g., *Y. enterocolitica*. Thus, the phospholipase may be fungal, e.g., from the class Pyrenomycetes, such as the genus *Fusarium*, such as a strain of *F. culmorum, F. heterosporum, F. solani*, or a strain of *F. oxysporum*. The phospholipase may also be from a filamentous fungus strain within the genus *Aspergillus*, such as a strain of *Aspergillus awamori, Aspergillus foetidus, Aspergillus japonicus, Aspergillus niger* or *Aspergillus oryzae*.

Preferred phospholipases are derived from a strain of *Humicola*, especially *Humicola lanuginosa*. The phospholipase may be a variant, such as one of the variants disclosed in WO 00/32758, which are hereby incorporated by reference. Preferred phospholipase variants include variants listed in Example 5 of WO 00/32758, which is hereby specifically incorporated by reference. In another preferred embodiment the phospholipase is one described in WO 04/111216, especially the variants listed in the table in Example 1. In another preferred embodiment the phospholipase is derived from a strain of *Fusarium*, especially *Fusarium oxysporum*. The phospholipase may be the one concerned in WO 98/026057 derived from *Fusarium oxysporum* DSM 2672, or variants thereof. In a preferred embodiment of the invention the phospholipase is a phospholipase A1 (EC. 3.1.1.32). In another preferred embodiment of the invention the phospholipase is a phospholipase A2 (EC.3.1.1.4.).

Examples of commercial phospholipases include LECITASE™ and LECITASE™ ULTRA, YIELSMAX, or LIPOPAN F (available from Novozymes A/S, Denmark).

Suitable amylases (alpha and/or beta) include those of bacterial or fungal origin. Chemically modified or protein engineered mutants are included. Amylases include, for example, alpha-amylases obtained from *Bacillus*, e.g. a special strain of *B. licheniformis*, described in more detail in GB 1,296,839, or the *Bacillus* sp. strains disclosed in WO 95/026397 or WO 00/060060.

Examples of useful amylases are the variants described in WO 94/02597, WO 94/18314, WO 96/23873, WO 97/43424, WO 01/066712, WO 02/010355, WO 02/031124 and PCT/DK2005/000469 (which references all incorporated by reference).

Commercially available amylases are Duramyl™, Termamyl™, Termamyl Ultra™, Natalase™, Stainzyme™, Fungamyl™ and BAN™ (Novozymes A/S), Rapidase™ and Purastar™ (from Genencor International Inc.).

Suitable peroxidases/oxidases include those of plant, bacterial or fungal origin. Chemically modified or protein engineered mutants are included. Examples of useful peroxidases include peroxidases from *Coprinus*, e.g. from *C. Cinereus*, and variants thereof as those described in WO 93/24618, WO 95/10602, and WO 98/15257. Commercially available peroxidases include Guardzyme™ and Novozym™ 51004 (Novozymes A/S).

Examples of pectate lyases include pectate lyases that have been cloned from different bacterial genera such as *Erwinia, Pseudomonas, Klebsiella* and *Xanthomonas*, as well as from *Bacillus subtilis* (Nasser et al. (1993) FEBS Letts. 335:319-326) and *Bacillus* sp. YA-14 (Kim et al. (1994) Biosci. Biotech. Biochem. 58:947-949). Purification of pectate lyases with maximum activity in the pH range of 8-10 produced by *Bacillus pumilus* (Dave and Vaughn (1971) J. Bacteriol. 108: 166-174), *B. polymyxa* (Nagel and Vaughn (1961) Arch. Biochem. Biophys. 93:344-352), *B. stearothermophilus* (Karbassi and Vaughn (1980) Can. J. Microbiol. 26:377-384), *Bacillus* sp. (Hasegawa and Nagel (1966) J. Food Sci. 31:838-845) and *Bacillus* sp. RK9 (Kelly and Fogarty (1978) Can. J. Microbiol. 24:1164-1172) have also been described. Any of the above, as well as divalent cation-independent and/or thermostable pectate lyases, may be used in practicing the invention. In preferred embodiments, the pectate lyase comprises the amino acid sequence of a pectate lyase disclosed in Heffron et al., (1995) Mol. Plant-Microbe Interact. 8:331-334 and Henrissat et al., (1995) Plant Physiol. 107: 963-976. Specifically contemplated pectate lyases are disclosed in WO 99/27083 and WO 99/27084. Other specifically contemplates pectate lyases derived from *Bacillus licheniformis* is disclosed as in U.S. Pat. No. 6,284,524 (which document is hereby incorporated by reference). Specifically contemplated pectate lyase variants are disclosed in WO 02/006442, especially the variants disclosed in the Examples in WO 02/006442 (which document is hereby incorporated by reference).

Examples of commercially available alkaline pectate lyases include BIOPREP™ and SCOURZYME™ L from Novozymes A/S, Denmark.

Combinations of enzymes are particularly preferred. Preferred combinations include mannanase together with one or more of lipase, protease and amylase. An especially preferred combination is one which includes each of mannanase, lipase, protease and amylase.

Any enzyme present in the composition may be stabilised using conventional stabilising agents, e.g., a polyol such as propylene glycol or glycerol, a sugar or sugar alcohol, lactic acid, boric acid, or a boric acid derivative, e.g., an aromatic borate ester, or a phenyl boronic acid derivative such as 4-formylphenyl boronic acid, and the composition may be formulated as described in e.g. WO 92/19709 and WO 92/19708.

In order that the present invention may be further understood and carried forth into practice it will be further described with reference to the following examples:

EXAMPLES

Example 1

Surface Attachment of Xyloglucan or Locust Bean Gum onto Perfume Encapsulates Via Melamine Formaldehyde Shell Formation Pre-formed melamine formaldehyde perfume encapsulates 10 micron in size were obtained from International Flavours and Fragrances (IFF) Limited. The particle solids were 51.9 wt % and perfume solids were 36.3 wt % respectively. The (tamarind) xyloglucan (XG) had a molecular weight of 650 kD and was obtained from Dainippon Pharmaceutical Co. Ltd. The Locust bean gum (LBG) has a molecular weight of 310 kD and was obtained from Sigma. All other materials were obtained from Aldrich Chemical Co. Ltd.

a) Pre-Polymer Preparation:

To a 100 ml conical flask was added 19.5 g formalin (37 wt % aqueous formaldehyde) and 44 g water. The pH of the solution was adjusted to 8.9 using 0.7 g of 5 wt % aqueous sodium carbonate. 10 g of melamine and 0.64 g of sodium chloride were added and the mixture stirred for 10 minutes at room temperature. The mixture was heated to 62° C. and stirred until it became clear. This mixture is hereinafter referred to as pre-polymer (1).

b) XG or LBG Attachment to Pre-Formed Melamine Formaldehyde Perfume Encapsulates:

1.5 g XG or LBG was dissolved in 98.5 g hot (70-80° C.) de-ionised water (500 g) by mixing with a high speed homogeniser (Silverson™) at 10,000 rpm for 10 minutes until completely solubilised. The solution was then allowed to cool to room temperature, under static conditions, to give a 1.5 wt % solution. 53.3 g of this XG or LBG solution was transferred to a 250 ml round bottomed flask fitted with overhead stirrer and condenser. 75.5 g of melamine formaldehyde encapsulates (51.9 wt % particle solids) and 67.7 g of de-ionised water were added and the mixture heated to 75° C. with stirring. 3.4 g of a freshly prepared pre-polymer (1) solution was added and the pH adjusted to 4.1, using 2.5 g of 10 wt % formic acid aqueous solution. The mixture was then left to stir, at 75° C. for 2 hours. The solution was then cooled and adjusted to pH 7 using 7.5 g of 5 wt % sodium carbonate aqueous solution.

A final dispersion (200 g) consisting of 20 wt % encapsulate solids containing an additional 2 wt % melamine formaldehyde shell and 2 wt % (based on final particle weight) of XG or LBG was obtained.

Example 2

Evaluation of Deposition Performance

The comparative deposition performance of XG-modified particles according to the invention and control LBG-modified particles onto cotton fabrics from a domestic laundering were evaluated using detergent formulation with and without mannanase enzyme. Deposition efficiency was assessed by measuring the amount of perfume on the fabric at the end of the wash using Gas Chromatography-Mass spectrometry (GC-MS).

a) Wash Procedure:

A wash load consisting of 2.5 kg of white cotton (2 white cotton bed sheets, 1 white cotton tablecloth, 2 white cotton hand towels, 1 white cotton tea towel, 2 white cotton pillowcases, 1 white cotton dress shirt and 40 monitor fabrics [20× 20 cm squares of white cotton terry towelling]) was placed into the drum of a Miele Softronic™ front loading automatic washing machine.

100 g of UK Persil™ Non-Bio powdered laundry detergent was dosed into the machine dispenser drawer. For the washes with mannanase enzyme, 0.11 g of Mannaway™ 4.0T (from Novozymes) was premixed with the detergent powder prior to dosing. The fabrics were subjected to one normal cottons wash cycle using a wash temperature of 40° C. and a spin speed of 900 rpm. The washing machine was supplied with water having a hardness of 25° FH. On completion of the wash, 10 of the terry towelling monitors were removed from the damp load and sealed into individual plastic bags ready for analysis.

b) Perfume Deposition Analysis:

The material deposited onto each of the terry towelling monitors was extracted in acetone using an accelerated solvent extraction system. The extract was then analysed with a Shimadzu GCMS-QP2010 GS-MS using a DB-1 column with methyl silicone stationary phase. Absolute levels of each perfume note in the extract were calculated by relating the area of the peak for each component to that of a known standard solution of the whole perfume. This was then converted to the amount of deposited perfume in units of microgram perfume per g of fabric (microgram/g). Results are shown in the table below. Higher numbers are indicative of better performance.

| | Perfume deposition/μg per g cloth | |
|---|---|---|
| Perfume encapsulate | Mannanase absent from wash (comparative) | Mannanase present in wash |
| Unmodified (control) | 18.0 ± 1.8 | |
| Modified with LBG (comparative) | 36 ± 1.2 | 20 ± 3.3 |
| Modified with XG | 35 ± 4.6 | 32 ± 3.4 |

The results show that both LBG and XG-modified perfume encapsulates give significantly better deposition onto cotton than the unmodified perfume encapsulate, when the wash does not contain the mannanase enzyme. However, when the wash contains the mannanase enzyme, then the current XG-modified encapsulates still give enhanced deposition, but the LBG-modified encaps show no significant benefit over the unmodified encapsulates.

Example 3

Surface Attachment of Xyloglucan onto Perfume Encapsulates Via Polyvinylacetate Shell Formation Formulations as indicated in the table below were used to prepare particles with a deposition aid attached to their outer surface. The required amount of xyloglucan was added slowly to hot water (95° C.) over a 15 minute period and stirred for one hour. After cooling to room temperature the perfume particles (52% solids) were added followed by the addition of vinyl acetate and flushing with water. The mixture was then purged with nitrogen for 5 minutes followed by sparging with nitrogen for a further 5 minute. The reaction mixture was then heated to 70 C with stirring at 120 rpm and a solution of ascorbic acid in water and hydrogen peroxide were added separately. Polymerization was allowed to proceed for 90 minutes. A second shot of ascorbic acid and hydrogen peroxide was then added and allowed to cook for a further 30 minutes before cooling to room temperature.

| | a | b | c | d | e | f | g | h | I |
|---|---|---|---|---|---|---|---|---|---|
| Soft Water | 132 | 132 | 132 | 132 | 132 | 132 | 145 | 145 | 145 |
| Xyloglucan | 2 | 2 | 2 | 2 | 4 | 6 | 2.2 | 4.4 | 6.6 |
| Perfume Particles (52%) | 338 | 338 | 338 | 338 | 338 | 338 | 378 | 378 | 378 |
| Vinyl acetate | 20 | 20 | 20 | 20 | 20 | 20 | 22 | 22 | 22 |
| Soft Water | 5 | 5 | 5 | 5 | 5 | 5 | 5.5 | 5.5 | 5.5 |
| Ascorbic acid | 0.5 | 0.5 | 0.5 | 0.5 | 0.5 | 0.5 | 0.55 | 0.55 | 0.55 |
| Soft Water | 4.5 | 4.5 | 4.5 | 4.5 | 4.5 | 4.5 | 4.95 | 4.95 | 4.95 |
| $H_2O_2$ (35%) | 1.43 | 1.43 | 1.43 | 1.43 | 1.43 | 1.43 | 1.57 | 1.57 | 1.57 |
| Ascorbic Acid | 0.1 | 0.1 | 0.1 | 0.1 | 0.1 | 0.1 | 0.11 | 0.11 | 0.11 |
| Soft Water | 0.9 | 0.9 | 0.9 | 0.9 | 0.9 | 0.9 | 0.99 | 0.99 | 0.99 |
| $H_2O_2$ (35%) | 0.29 | 0.29 | 0.29 | 0.29 | 0.29 | 0.29 | 0.319 | 0.319 | 0.319 |

The resulting particles had the properties given in the table below:

| | a | b | c | d | e | f | g | h | i |
|---|---|---|---|---|---|---|---|---|---|
| Theoretical Solids Content % | 39.57 | 39.56 | 39.56 | 39.60 | 39.8 | 40.05 | 39.44 | 39.87 | 40.123 |
| Actual Solids Content/% | 36.76 | 36.75 | 36.62 | 36.84 | 37.37 | 37.35 | 36.26 | 37.08 | 37.45 |
| Viscosity at 20 rpm/cP | 444 | 442 | 300 | 364 | 642 | 910 | 624 | 752 | 1486 |
| pH | 4.87 | 4.9 | 4.82 | 6.88 | 5.76 | 5.22 | 4.8 | 4.83 | 4.86 |
| Particle Size/μm | 38.95 ± 34.27 | 30.47 ± 22.54 | 30.44 ± 23.3 | 34.96 ± 28.71 | 32.41 ± 23.48 | 30.19 ± 20.62 | 36.27 ± 28.05 | 35.38 ± 30.55 | 36.27 ± 34.87 |

The viscosities obtained in these examples and otherwise when using vinyl acetate/xyloglucan are relatively low, which facilitates processing.

The invention claimed is:

1. A composition comprising:

a) a benefit agent delivery particle wherein the benefit agent delivery particle comprises:

(i) a core;

wherein the core comprises perfume, (ii) at least one shell surrounding the core;

wherein the at least one shell is aminoplast shell; and (iii) an outer layer;

wherein the outer layer comprises polyvinyl acetate and a delivery aid;

wherein the delivery aid is selected from the group consisting of a polygalactomannan and mixtures of the polygalactomannan and a polyxyloglucan;

wherein the polygalactomannan and the polyxyloglucan have a ratio of beta 1,4 to 1,6 linkages of 0.5:1 to 3:1;

and b) a mannanase.

2. The composition of claim 1, wherein the delivery aid is the polygalactomannan.

3. The composition of claim 1, wherein the delivery aid is the mixture of the polyxyloglucan and the polygalactomannan.

4. The composition of claim 1, further comprising at least one of lipase, protease or amylase.

5. The composition of claim 4, comprising lipase, protease and amylase.

* * * * *